US010259034B2

(12) United States Patent
Oguma et al.

(10) Patent No.: US 10,259,034 B2
(45) Date of Patent: Apr. 16, 2019

(54) SLURRY FOR FORMING MOLD, MOLD AND METHOD FOR PRODUCING MOLD

(71) Applicant: MITSUBISHI HEAVY INDUSTRIES, LTD., Tokyo (JP)

(72) Inventors: Hidetaka Oguma, Tokyo (JP); Kazutaka Mori, Tokyo (JP); Ichiro Nagano, Tokyo (JP); Masato Shida, Tokyo (JP); Ikuo Okada, Tokyo (JP); Ryota Okimoto, Tokyo (JP); Yoshitaka Uemura, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 165 days.

(21) Appl. No.: 15/116,628

(22) PCT Filed: Mar. 4, 2015

(86) PCT No.: PCT/JP2015/056360
§ 371 (c)(1),
(2) Date: Aug. 4, 2016

(87) PCT Pub. No.: WO2015/137212
PCT Pub. Date: Sep. 17, 2015

(65) Prior Publication Data

US 2016/0354836 A1 Dec. 8, 2016

(30) Foreign Application Priority Data

Mar. 12, 2014 (JP) ..... 2014-049226

(51) Int. Cl.

| | |
|---|---|
| ***B22C 1/18*** | (2006.01) |
| ***B22C 3/00*** | (2006.01) |
| ***B22C 7/02*** | (2006.01) |
| ***B22C 9/04*** | (2006.01) |
| ***B22C 9/12*** | (2006.01) |

(52) U.S. Cl.
CPC ..... *B22C 1/183* (2013.01); *B22C 3/00* (2013.01); *B22C 7/02* (2013.01); *B22C 9/04* (2013.01); *B22C 9/043* (2013.01); *B22C 9/12* (2013.01)

(58) Field of Classification Search
CPC .. B22C 1/18; B22C 1/183; B22C 3/00; B22C 7/02; B22C 9/04; B22C 9/043; B22C 9/12
USPC ..... 164/516, 517, 518, 519, 520, 529, 361; 106/38.9
See application file for complete search history.

(56) References Cited

U.S. PATENT DOCUMENTS 7,638,459 B2 * 12/2009 Rende et al. ..... B01J 21/063 502/240
2006/0270865 A1 * 11/2006 Wang et al. ..... B01J 23/44 554/174

FOREIGN PATENT DOCUMENTS

JP 54-130438 10/1979
JP 61-222658 10/1986
(Continued)

OTHER PUBLICATIONS

International Search Report dated Apr. 7, 2015 in corresponding International Application No. PCT/JP2015/056360 (with English translation).

(Continued)

*Primary Examiner* — Kevin P Kerns
(74) *Attorney, Agent, or Firm* — Wenderoth, Lind & Ponack, L.L.P.

(57) ABSTRACT

A slurry for forming a mold includes a silica sol as a dispersion medium and niobia-stabilized zirconia dispersed in the silica sol.

9 Claims, 2 Drawing Sheets

(56) References Cited

FOREIGN PATENT DOCUMENTS

| | | |
|---|---|---|
| JP | 1-108162 | 4/1989 |
| JP | 6-15404 | 1/1994 |
| JP | 2718460 | 2/1998 |

OTHER PUBLICATIONS

Written Opinion of the International Searching Authority dated Apr. 7, 2015 in corresponding International Application No. PCT/JP2015/056360 (with English translation).

* cited by examiner

SLURRY FOR FORMING MOLD, MOLD AND METHOD FOR PRODUCING MOLD

TECHNICAL FIELD

The invention relates to a slurry for forming a mold, a mold, and a method for producing a mold.

Priority is claimed on Japanese Patent Application No. 2014-049226, filed Mar. 12, 2014, the content of which is incorporated herein by reference.

BACKGROUND ART

Regarding a mold for casting a metal, an alloy, or the like, there may be cases where the strength of the mold is too high when a casting is taken out and it is difficult to separate the mold. When the casting is taken out of the mold, the mold may be destroyed by an impact of a hammer, sandblasting, steel shot, or the like. Therefore, there is a possibility that damage from the impact caused by destroying the mold may be imparted to the casting and defects may be generated.

As a mold, a mold which is formed by mixing zircon, alumina, or the like with a silica sol and baking the mixture is known. Generally, such a mold is less likely to contract due to temperature decrease, and the coefficient of linear expansion thereof has a value different from that of a metal for the casting by one order of magnitude. Therefore, when the casting is cooled, a tensile stress is exerted on the casting due to contraction, and there is a possibility that defects such as cracks may be generated in the casting.

In PTL 1, a technique in which a mold is formed by using a material containing 10 wt % or more of zirconia is suggested. In the technique of PTL 1, the property of zirconia, in which the crystal structure thereof transitions according to temperature is used. That is, by using a mold, which is increased in temperature as molten metal is poured, a countless number of fine cracks are generated in the mold, which causes the mold to collapse in on itself.

CITATION LIST

Patent Literature

[PTL 1] Japanese Unexamined Patent Application, First Publication No. H6-015404

SUMMARY OF INVENTION

Technical Problem

However, the crystal structure of zirconia mentioned above transitions, for example, from orthorhombic to tetragonal at a temperature of about 1100° C., resulting in a change in volume. Therefore, in a process of pouring the molten metal into the mold, a change in the volume of the mold occurs, and there is a possibility that it may become difficult to perform precision casting.

An object of the invention is to provide a slurry for forming a mold, a mold, and a method for producing a mold, in which a casting can be stably molded and the mold easily collapses in on itself.

Solution to Problem

According to a first aspect of the present invention, a slurry for forming a mold includes: a silica sol as a dispersion medium; and niobia-stabilized zirconia dispersed in the silica sol.

According to a second aspect of the present invention, a mold includes: a primary layer and a backup layer provided from an inside in this order, in which at least one of the primary layer and the backup layer is formed by performing a heat treatment on the slurry for forming a mold according to the first aspect.

According to a third aspect of the present invention, a method for producing a mold includes: a slurry production process of producing a slurry in which niobia-stabilized zirconia is dispersed in a silica sol as a dispersion medium; a slurry layer formation process of forming a slurry layer in which the slurry is adhered to a surface of a wax mold; a stucco layer formation process of forming a stucco layer in which particles of a refractory material are adhered to a surface of the slurry layer; and a heat treatment process of performing a heat treatment on the slurry layer and the stucco layer.

Advantageous Effects of Invention

According to the slurry for forming a mold, the mold, and the method for producing a mold, a casting can be stably molded, and the mold can easily collapse in on itself.

DESCRIPTION OF EMBODIMENTS

Hereinafter, a slurry for forming a mold, a mold, and a method for producing a mold according to an embodiment of the present invention will be described.

The slurry for forming a mold (hereinafter, simply referred to as slurry) of the embodiment includes a silica sol as a dispersion medium, and niobia-stabilized zirconia ($NbO_2.ZrO_2$) dispersed in the silica sol. The niobia-stabilized zirconia is dispersed in the silica sol as the dispersion medium, thereby forming the slurry. The niobia-stabilized zirconia is in a stable state at a temperature of up to about 1100° C., in which a crystal structure thereof niobia-stabilized zirconia is not changed. On the other hand, niobia-stabilized zirconia is destabilized when about 1200° C. is reached and is separated into niobia and zirconia. The crystal of the separated zirconia undergoes a structural change according to temperature, like general zirconia. That is, the crystal structure of zirconia has a tetragonal phase at a high temperature (for example, at a temperature of higher than 1000° C.) and has an orthorhombic phase at a low temperature (for example, at a temperature of 1000° C. or less).

A wetting improving agent, a defoamer, and the like may also be added to the slurry.

The wetting improving agent may be added to improve the wettability of the slurry for a wax mold. For example, Victor Wet 12 (registered trademark, made by Freeman (Japan) Co., Ltd.) or the like may be used as the wetting improving agent. The Victor Wet 12 is a surfactant added during mold making such as precision casting.

The defoamer may be added in order to prevent the formation of foam in the slurry. For example, ANTIFOAM 1410 (made by Dow Corning Corporation) or the like may be used as the defoamer.

Figure 1:
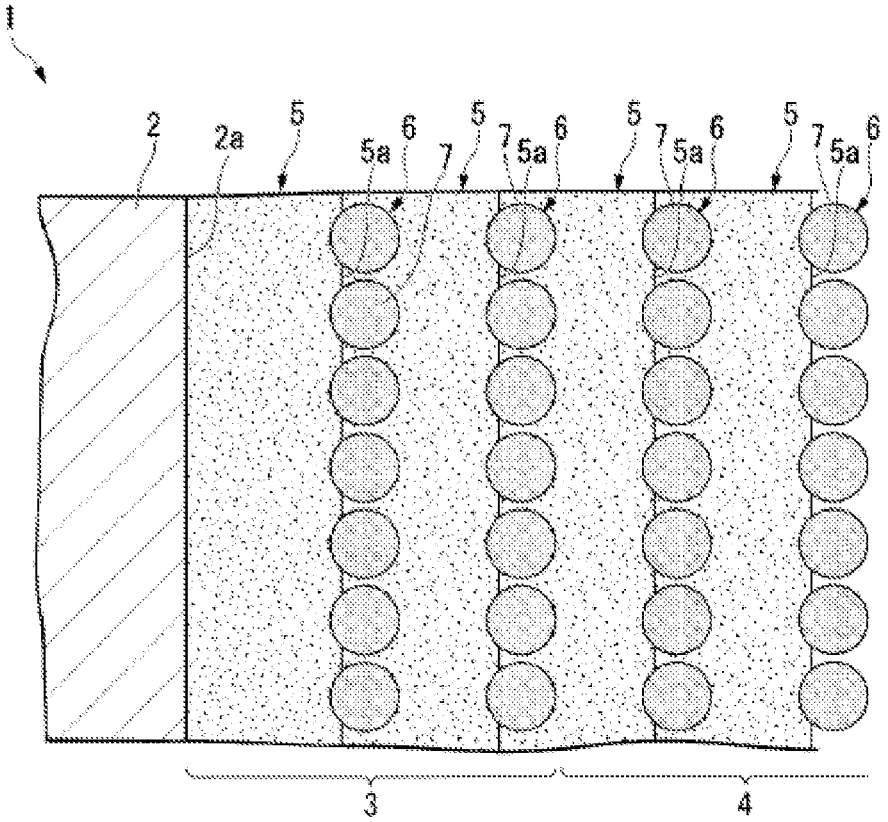
FIG. 1 is a sectional view showing a slurry and stucco in an embodiment of the present invention.

FIG. 1 is a sectional view showing the slurry and stucco in the embodiment of the invention.

As shown in FIG. 1, a mold 1 in this embodiment includes a primary layer 3 and a backup layer 4 laminated on a surface 2*a* of a wax mold 2. The primary layer 3 and the backup layer 4 are formed such that a niobia-stabilized zirconia layer 5 formed from the slurry and a stucco layer 6 formed from particles of a heat-resistant material (hereinafter, simply referred to as stucco) are alternately laminated.

The primary layer 3 indicates one to two layers from the inside of the mold 1 in the laminate of the niobia-stabilized zirconia layer 5 and the stucco layer 6. Since the primary layer 3 is a layer that comes into contact with a casting, it is preferable that the primary layer 3 is formed from fine particles that do not react with the casting.

The backup layer 4 is a layer that primarily takes charge of strength in the mold. The backup layer 4 is disposed on the outside of the primary layer 3. The backup layer 4 is formed with a thickness corresponding to a necessary strength.

The stucco layer 6 is formed of particles 7 of a refractory material adhered to a surface 5*a* of the niobia-stabilized zirconia layer 5. The particles 7 of the refractory material may be exemplified by coarse particles (with a particle size of 0.2 mm to 1.0 mm) called stucco such as mullite or alumina.

(Method for Producing Mold)

Next, a method for producing a mold in the embodiment will be described with reference to the drawings.

Figure 2:
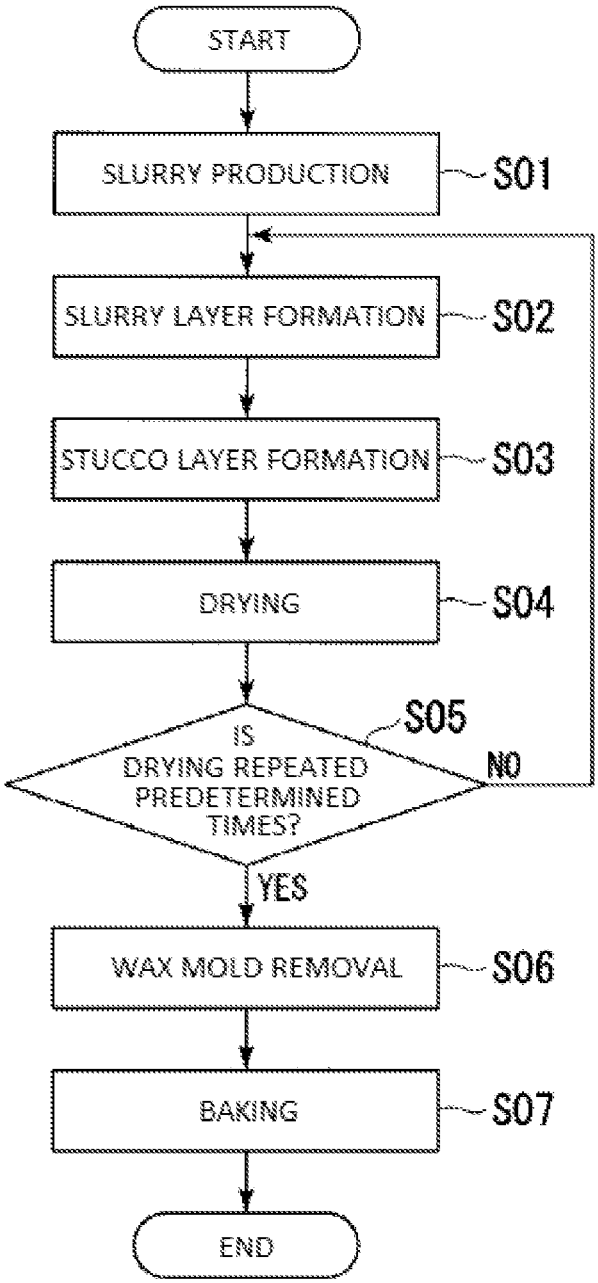
FIG. 2 is a flowchart of a method for producing a mold in the embodiment of the present invention.

FIG. 2 is a flowchart of the method for producing a mold in the embodiment of the invention.

In the method for producing a mold of the embodiment, the wax mold 2 is formed in advance by injection molding or the like. Specifically, first, a wax is poured into a mold in which a core material is buried. Next, the mold is removed, and a wax molded part in which the outside of the core material is covered with the wax is taken out of the mold. Thereafter, a sprue and a gate for wax molding are attached to the wax molded part, thereby obtaining the wax mold 2.

As shown in FIG. 2, first, in a slurry production process, particles of niobia-stabilized zirconia are dispersed in a silica sol as a dispersion medium such that a slurry is produced (Step S01).

Next, in a slurry layer formation process, the wax mold 2 is immersed in the slurry and is thereafter pulled such that a slurry layer is formed on the surface 2*a* of the wax mold 2 (Step S02).

Furthermore, in a stucco layer formation process, the particles 7 of the refractory material are sprinkled over the surface of the slurry layer such that the stucco layer 6 is formed (Step S03). Since the refractory material has excellent water-absorbing properties, moisture in the slurry layer is absorbed and the slurry layer enters a semi-dried state.

Thereafter, in a drying process, the wax mold 2 in which the slurry layer and the stucco layer 6 are laminated are put in a drying chamber and is dried, for example, for about two hours (Step S04). A series of processes including the slurry layer formation process, the stucco layer formation process, and the drying process are performed once such that a layer of about 0.5 mm to 2 mm is formed on the surface 2*a* of the wax mold 2.

The series of processes including the slurry layer formation process, the stucco layer formation process, and the drying process are repeated a predetermined number of times (for example, several times to tens of times) (Step S05).

Thereafter, the wax mold 2 is removed (Step S06), and baking is performed thereon (heat treatment process (Step S07)). The wax mold is removed using an autoclave or the like by melting the wax in heated steam at about 150° C. under 10 atmospheres. In addition, the baking is performed at a temperature of 980° C. for 1 to 10 hours.

Here, for example, when a casting such as a turbine blade is produced, a pouring process of pouring molten metal into a mold is performed. In addition, after the casting is taken out of the mold, a core removing process of allowing a core material in the casting to be eluted in a high-temperature alkali solution is performed.

In the pouring process, the mold is pre-heated at 1100° C. or higher and is rapidly set in a furnace. Thereafter, in a vacuum, molten alloy (molten metal) at about 1500° C. is poured into the mold.

In the core removing process, the sprue and the gate are cut, and a finishing operation is performed. Thereafter, the obtained alloy is put into the high-temperature alkali solution. As the high-temperature alkali solution, for example, a solution of about 40 wt % to 50 wt % sodium hydroxide (NaOH) or potassium hydroxide (KOH) heated to a temperature of about 180° C. may be used. The alloy is immersed into the solution for about 12 to 24 hours, and pressurization and depressurization are repeated. Accordingly, the core material in the alloy and a coating on the surface of the core material are eluted, and a turbine blade which is formed of the alloy and has a hollow structure can be obtained. The turbine blade is subjected to finishing through sandblasting or by a grinder, and dimensional inspection, Zyglo inspection, X-ray inspection, and the like are performed thereon.

After the above-described pouring process is completed, before the core removing process is performed, the casting that is cooled and solidified is taken out of the mold 1. More specifically, the mold 1 is cooled to collapse in on itself and the casting is taken out.

When the niobia-stabilized zirconia that forms the mold 1 is heated to about 1200° C. by the molten metal, the niobia-stabilized zirconia is destabilized. Accordingly, the niobia-stabilized zirconia is separated into niobia and zirconia as described above. When the niobia-stabilized zirconia is destabilized, zirconia is at 1000° C. or higher and has a tetragonal phase. On the other hand, when the temperatures of the casting and the mold decrease during cooling and become lower than 1000° C., zirconia transitions to orthorhombic. At this time, zirconia undergoes volume expansion and the strength thereof is extremely reduced. Therefore, when a force is exerted on the mold due to a difference in coefficient of linear expansion or the like between the mold and the casting, the mold collapses in on itself. Here, even in a case where self-collapsing is insufficient, since a large number of cracks are included in the mold, the mold can be easily destroyed with a minimal impact.

Next, Examples and Comparative Examples of the mold described above will be described.

Example 1

First, a niobia-stabilized zirconia powder ($NbO_2.ZrO_2$) was injected into a silica sol as a dispersion medium, thereby forming a slurry. Furthermore, OT-75 as a wetting improving agent and ANTIFOAM 1410 as defoamer were added thereto, thereby obtaining a slurry for forming a mold.

A wax mold was immersed into the slurry and was thereafter pulled upward such that the remaining slurry was dropped. Next, coarse particles (0.2 mm to 1 mm) of stucco formed of mullite or alumina were sprinkled over the slurry on the wax mold. Accordingly, the stucco had adhered to the wet slurry and absorbed extra water from the slurry such that the slurry entered a semi-dried state.

Next, the resultant was put into a drying chamber for two or more hours so as to be dried. Accordingly, the sum of the thicknesses of a slurry layer and a stucco layer became 0.5 mm to 2 mm. This operation was repeated several times to tens of times to laminate the slurry layer and the stucco layer until a thickness with which sufficient strength was obtained was reached, thereby forming a primary layer and a backup layer.

Thereafter, wax was removed in an autoclave at 150° C. and the resultant was subjected to a heat treatment (baking) at 980° C., thereby obtaining a mold.

The mold was pre-heated at 1100° C. or higher to be warmed up, and molten metal was poured thereinto. In this case, the niobia-stabilized zirconia was destabilized. Thereafter, when the mold was cooled, the crystal structure of zirconia had transitioned from tetragonal to orthorhombic, the mold had collapsed in on itself, and thus a casting could be simply taken out. When the mold that had collapsed in on itself was observed, volume expansion and a large number of cracks could be confirmed, and the entire mold was embrittled.

Example 2

A niobia-stabilized zirconia powder ($NbO_2.ZrO_2$) was injected into a silica sol as a dispersion medium, thereby forming a slurry. Furthermore, OT-75 as a wetting improving agent and ANTIFOAM 1410 as defoamer were added thereto, thereby forming a backup slurry for forming a backup layer.

In addition, zircon flour ($ZrSiO_4$) was dispersed in a silica sol as a dispersion medium, thereby forming a slurry. Furthermore, Victor Wet 12 as a wetting improving agent and ANTIFOAM 1410 as defoamer were added thereto, thereby forming a primary slurry for forming a primary layer.

A wax mold was immersed into the primary slurry and was thereafter pulled upward such that the remaining primary slurry was dropped. Next, coarse particles (0.2 mm to 1 mm) of stucco formed of mullite or alumina were sprinkled over the slurry on the wax mold. Accordingly, the stucco had adhered to the wet slurry and absorbed extra water from the slurry such that the slurry entered a semi-dried state.

Next, the resultant was put in a drying chamber for two or more hours so as to be dried. Accordingly, the sum of the thicknesses of a slurry layer and a stucco layer became 0.5 mm to 2 mm. This operation was repeated once or twice, thereby forming a primary layer.

Thereafter, a wax mold was immersed into the backup slurry and was thereafter pulled upward such that the remaining backup slurry was dropped. Next, coarse particles (0.2 mm to 1 mm) of stucco formed of mullite or alumina were sprinkled over the slurry on the wax mold. Accordingly, the stucco had adhered to the wet slurry and absorbed extra water from the slurry such that the slurry entered a semi-dried state. This operation was repeated several times to tens of times to laminate a slurry layer and a stucco layer until a thickness with which sufficient strength was obtained was reached, thereby forming a backup layer.

Thereafter, wax was removed in an autoclave at 150° C. and the resultant was subjected to a heat treatment (baking) at 980° C., thereby obtaining a mold.

The mold was pre-heated at 1100° C. or higher to be warmed up, and molten metal was poured thereinto. In this case, the niobia-stabilized zirconia was destabilized. Thereafter, when the mold was cooled, the crystal structure of zirconia had transitioned from tetragonal to orthorhombic, the mold had collapsed in on itself, and thus a casting could be simply taken out. When the mold that had collapsed in on itself was observed, volume expansion and a large number of cracks could be confirmed, and the entire mold was embrittled.

Comparative Example

Zircon flour was dispersed in a silica sol as a dispersion medium, thereby forming a slurry. Furthermore, Victor Wet 12 as a wetting improving agent and ANTIFOAM 1410 as defoamer were added thereto, thereby forming a slurry for forming a mold.

In addition, a wax mold was immersed into the slurry and was thereafter pulled upward such that the remaining slurry was dropped. Next, coarse particles (with a particle size of 0.2 mm to 1 mm) of stucco formed of mullite or alumina were sprinkled over the slurry on the wax mold. Accordingly, the stucco had adhered to the wet slurry and absorbed extra water from the slurry such that the slurry entered a semi-dried state.

Next, the resultant was put in a drying chamber for two or more hours so as to be dried. Accordingly, the sum of the thicknesses of a slurry layer and a stucco layer became 0.5 mm to 2 mm. This operation was repeated several times to tens of times to laminate a slurry layer and a stucco layer until a thickness with which sufficient strength was obtained was reached. At this time, both a primary layer and a backup layer were formed using the same slurry.

Thereafter, wax was removed in an autoclave at 150° C. and the resultant was baked at 900° C. to 1200° C., thereby obtaining a mold.

Furthermore, molten metal was poured into the mold and was cooled, thereby forming a casting.

After the cooling, an impact such as an impact of a hammer was repeatedly applied to the mold, and the casting was taken out. The casting taken out of the mold was inspected, and defects were discovered.

Therefore, according to the above-described embodiment, when molten metal is poured and reaches a high temperature, niobia-stabilized zirconia can be destabilized. Furthermore, the niobia-stabilized zirconia can be separated into niobia and zirconia due to the destabilization. Therefore, when a casting is cooled, the crystal structure of the zirconia is changed, which causes a change in volume and a reduction in strength. Therefore, the self-collapsing properties of the mold 1 can be improved. As a result, a change in volume was suppressed in the process of pouring the molten metal, and the casting can be stably formed. In addition, the mold 1 can easily collapse in on itself Furthermore, even in a case where a slurry containing niobia-stabilized zirconia is used only for the backup layer 4 of the primary layer 3 and the backup layer 4, the self-collapsing properties of the mold 1 can be sufficiently improved.

The present invention is not limited to the above-described embodiment, and includes various modifications added to the above-described embodiment without departing from the scope of the present invention. That is, specific shapes, configurations, and the like employed in the embodiment are merely examples and can be appropriately modified.

For example, in Example 2 described above, the case where the niobia-stabilized zirconia was used only for the backup layer 4 is described as an example. However, the niobia-stabilized zirconia may also be used only for the primary layer 3. As described above, even in the case where the niobia-stabilized zirconia is used only for the primary layer 3, the self-collapsing properties of the mold can be improved.

In addition, in the above-described embodiment, the case where the casting is a turbine blade was exemplified. However, castings other than the turbine blade can also be applied.

INDUSTRIAL APPLICABILITY

The present invention can be applied to a slurry for forming a mold, a mold, and a method for producing a mold, in which a casting can be stably molded, and the mold can easily collapse in on itself.

REFERENCE SIGNS LIST

1 MOLD
2 WAX MOLD
2*a* SURFACE
3 PRIMARY LAYER
4 BACKUP LAYER
5 NIOBIA-STABILIZED ZIRCONIA LAYER
5*a* SURFACE
6 STUCCO LAYER
7 PARTICLE

What is claimed is:

1. A slurry for forming a mold comprising:
a silica sol as a dispersion medium; and
a niobia-stabilized zirconia dispersed in the silica sol, wherein:
the niobia-stabilized zirconia is capable of being destabilized when about 1200° C. or more is reached and being separated into a niobia and a zirconia, and
a crystal structure of the separated zirconia varies below a temperature at which the destabilization occurs.

2. The slurry for forming a mold according to claim 1,
wherein the crystal structure of the separated zirconia has a tetragonal phase at a temperature of higher than 1000° C. and has an orthorhombic phase at a temperature of 1000° C. or less.

3. A mold comprising:
a primary layer and a backup layer provided from an inside in this order,
wherein at least one of the primary layer and the backup layer is formed by performing a heat treatment on the slurry for forming a mold according to claim 1.

4. A method for producing a mold comprising:
a slurry production process of producing a slurry in which a niobia-stabilized zirconia is dispersed in a silica sol as a dispersion medium;
a slurry layer formation process of forming a slurry layer in which the slurry is adhered to a surface of a wax mold;
a stucco layer formation process of forming a stucco layer in which particles of a refractory material are adhered to a surface of the slurry layer; and
a heat treatment process of performing a heat treatment on the slurry layer and the stucco layer, wherein:
the niobia-stabilized zirconia is capable of being destabilized when about 1200° C. or more is reached and being separated into a niobia and a zirconia, and
a crystal structure of the separated zirconia varies below a temperature at which the destabilization occurs.

5. The method for producing a mold according to claim 4,
wherein the crystal structure of the separated zirconia has a tetragonal phase at a temperature of higher than 1000° C. and has an orthorhombic phase at a temperature of 1000° C. or less.

6. A mold comprising:
a primary layer and a backup layer provided from an inside in this order,
wherein the primary layer and the backup layer are formed by baking such that a niobia-stabilized zirconia layer formed from a slurry for forming a mold including a silica sol as a dispersion medium and a niobia-stabilized zirconia dispersed in the silica sol and a stucco layer formed from particles of a heat-resistant material are alternately laminated,
the niobia-stabilized zirconia is capable of being destabilized when about 1200° C. or more is reached and being separated into a niobia and a zirconia, and
a crystal structure of the separated zirconia varies below a temperature at which the destabilization occurs.

7. The mold according to claim 6,
wherein the crystal structure of the separated zirconia has a tetragonal phase at a temperature of higher than 1000° C. and has an orthorhombic phase at a temperature of 1000° C. or less.

8. A method for producing a mold comprising:
a slurry production process of producing a slurry in which a niobia-stabilized zirconia is dispersed in a silica sol as a dispersion medium;
a slurry layer formation process of forming a slurry layer in which the slurry is adhered to a surface of a wax mold;
a stucco layer formation process of forming a stucco layer in which particles of a refractory material are adhered to a surface of the slurry layer;
a drying process of drying the laminated slurry layer and the stucco layer; and
a heat treatment process of performing a heat treatment on the slurry layer and the stucco layer after repeating the slurry layer formation process, the stucco layer formation process, and the drying process a plurality of times, wherein:
the niobia-stabilized zirconia is capable of being destabilized when about 1200° C. or more is reached and being separated into a niobia and a zirconia, and
a crystal structure of the separated zirconia varies below a temperature at which the destabilization occurs.

9. The method for producing a mold according to claim 8,
wherein the crystal structure of the separated zirconia has a tetragonal phase at a temperature of higher than 1000° C. and has an orthorhombic phase at a temperature of 1000° C. or less.

* * * * *